US008286622B2

(12) United States Patent
Halmone

(10) Patent No.: US 8,286,622 B2
(45) Date of Patent: Oct. 16, 2012

(54) VALVE WITH BLOW BACK RESERVOIR

(75) Inventor: Fabrice N. V. Halmone, Ville la Grand (FR)

(73) Assignee: Kingman International Corporation, Baldwin park, CA (US)

( * ) Notice: Subject to any disclaimer, the term of this patent is extended or adjusted under 35 U.S.C. 154(b) by 370 days.

(21) Appl. No.: 12/415,936

(22) Filed: Mar. 31, 2009

(65) Prior Publication Data

US 2010/0242939 A1 Sep. 30, 2010

(51) Int. Cl.
*F41B 11/00* (2006.01)
*F41A 9/61* (2006.01)

(52) U.S. Cl. ..... 124/76; 124/74

(58) Field of Classification Search ..... 124/76, 124/74

See application file for complete search history.

(56) References Cited

U.S. PATENT DOCUMENTS

| | | | | |
|---|---|---|---|---|
| 4,099,465 | A * | 7/1978 | Haake | 102/204 |
| 6,418,920 | B1 * | 7/2002 | Marr | 124/74 |
| 6,889,681 | B1 * | 5/2005 | Alexander et al. | 124/72 |
| 6,973,748 | B2 * | 12/2005 | Rice | 42/69.01 |
| 7,150,276 | B1 * | 12/2006 | Rice | 124/73 |
| 7,967,000 | B2 * | 6/2011 | Walker et al. | 124/73 |
| 2005/0011508 | A1 * | 1/2005 | Kunimoto | 124/73 |
| 2006/0037597 | A1 * | 2/2006 | Wood | 124/73 |
| 2007/0181116 | A1 * | 8/2007 | Wei | 124/74 |
| 2008/0060630 | A1 * | 3/2008 | Halmone | 124/73 |
| 2008/0078971 | A1 * | 4/2008 | Quinn et al. | 251/205 |
| 2009/0114201 | A1 * | 5/2009 | Halmone | 124/74 |
| 2009/0260610 | A1 * | 10/2009 | Walker et al. | 124/73 |
| 2010/0126486 | A1 * | 5/2010 | Halmone et al. | 124/74 |

* cited by examiner

*Primary Examiner* — Michael David
(74) *Attorney, Agent, or Firm* — Blakely, Sokoloff, Taylor & Zafman LLP

(57) ABSTRACT

A compact paintball marker having a valve with a blow back hole and reservoir. The blow back hole and reservoir increase the percentage of the compressed gas that is released in response to a trigger pull that is utilized to push the striker back to a cocked position. This improves the reliability of the automatic re-cocking of the marker even when there is low pressure from the compressed gas source.

18 Claims, 6 Drawing Sheets

VALVE WITH BLOW BACK RESERVOIR

BACKGROUND

1. Field of the Invention

The present invention relates to a valve mechanism for a paintball marker. Specifically, the valve mechanism generates a larger pressure or 'blow back' against a striker mechanism when the valve is activated to ensure that the paintball marker is automatically re-cocked after firing.

2. Description of the Related Art

Most paintball markers are shaped to resemble rifles having long barrels and housings. The long housings are necessary to accommodate the internal components of the marker including the striker mechanism and bolt mechanism. The housing of a paintball marker defines two parallel tubes in which these components may be disposed. The top tube or barrel includes a bolt that positions a paintball and directs airflow behind the paintball to propel the paintball. The paintball is inserted into the barrel from a loader that is positioned above the marker housing and has a feeding tube to guide the paintballs into the barrel.

The second tube is directly below the barrel and parallel to the barrel. The second tube contains a striker mechanism that repositions the bolt to load the next paintball after firing and readies the marker for the next firing. The striker mechanism also releases compressed gas into the barrel in response to the activation of a trigger mechanism. A valve is positioned in a distal end of the second tube. The valve controls the flow of gas into the second tube from the compressed gas container that is externally attached to the marker. The valve is activated by the striker mechanism in response to the trigger activation. The striker mechanism is spring loaded at a proximal end of the second tube and held in a compressed position by the sear in the trigger mechanism.

Depressing the trigger releases the striker, which advances into contact with valve due to the decompression of the spring. The striker mechanism is also coupled to the bolt. Advancing the bolt opens an airflow path into the barrel through the bolt and seals the barrel from the feeder tube of the loader. The contact with the valve releases compressed gas into the second tube and the barrel propelling the paintball out of the marker and pushing the striker mechanism back to a cocked position. The valve focuses the release of the compressed gas into the bolt to maximize the speed and distance that the paintball is propelled. The compressed gas has a path to the striker through the hole in which the valve pin is disposed. However, this path is narrow and restricted by the position of the valve pin, as a result, the striker mechanism is not always pushed back to a cocked position and must be manually re-cocked.

BRIEF DESCRIPTION OF THE DRAWINGS

Embodiments of the invention are illustrated by way of example and not by way of limitation in the figures of the accompanying drawings in which like references indicate similar elements. It should be noted that different references to "an" or "one" embodiment in this disclosure are not necessarily to the same embodiment, and such references mean at least one.

DETAILED DESCRIPTION

In the following description, for the purpose of explanation, numerous specific details are set forth to provide a thorough understanding of the various embodiments. It will be apparent to one of ordinary skill in the art that the embodiments may be practiced without some of these specific details. In other instances, certain structures and devices are omitted or simplified to avoid obscuring the details of the various embodiments.

The following description and the accompanying drawings provide examples for the purposes of illustration. However, these examples should not be construed in a limiting sense as they are not intended to provide an exhaustive list of all possible implementations.

Figure 1:
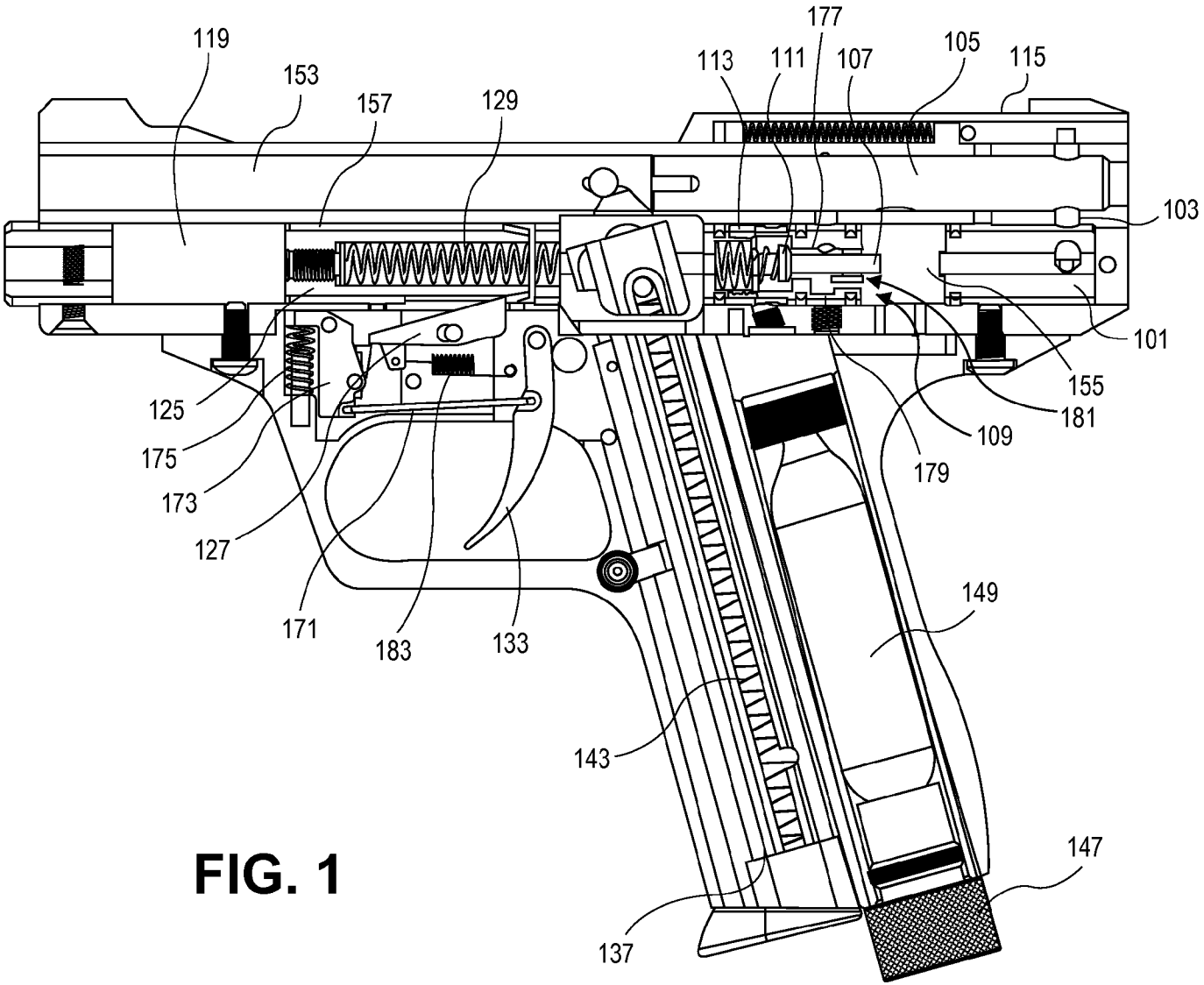
FIG. 1 is a diagram depicting a cross-section of one embodiment of a compact marker and valve mechanism.

FIG. 1 is a diagram depicting a cross section of one embodiment of a compact marker. In one embodiment, a maker propels paintballs in response to a pull of the trigger mechanism by a user. A marker can be used to mark trees, livestock or similar items at a distance or can be used in paintball sports where the user attempts to mark an opponent. The marker utilizes compressed gases as propellant for the paintballs. The marker can be a pump action, semi-automatic or fully-automatic device. For purposes of clarity the embodiments described herein relate to a semi-automatic device. One skilled in the art would understand that the principles and design are also applicable to other types of markers.

In one embodiment, a marker includes a housing containing multiple sub-assemblies including a trigger mechanism, a striker mechanism, a gas delivery mechanism, a paintball delivery mechanism and similar sub-assemblies or components. The housing defines a set of compartments or cavities for receiving the sub-assemblies or components of the marker.

These spaces include a barrel 153 through which a paintball exits the marker. The barrel 153 can have any diameter and length. In one embodiment, the length of the barrel 153 and marker is less than ten inches in length or approximately 200 mm. In another embodiment, the length of the barrel 153 and marker is less than eight inches in length. In a further embodiment, the length of the barrel 153 is greater than ten inches. The diameter of the barrel 153 can be selected to match a size of a type of paintball or similar projectile (e.g., bb or foam ball) capable of pneumatic firing. For example, the barrel 153 can be designed to accommodate an 11 mm paintball.

A bolt 105 is disposed within the barrel 153. The bolt 105 slides from a first position in the barrel 153 to a second position in the barrel 153. The bolt 105 defines an airflow path that directs gas toward the paintball propelling it out of the barrel 153. The bolt 105 defines an opening in its outer wall that can be aligned with an opening in the barrel 153 through which gas from the valve 109 can be received if the bolt 105 is in the second position. In the second position, the outer wall of the bolt 105 blocks a path from the feeding tube into the chamber of the barrel 153 preventing another paintball from entering the barrel 153 during a firing action. If the bolt 105 is in the first position the outer wall of the bolt 105 blocks the airflow path, preventing the escape of compressed air. In the first position, a paintball may also enter the barrel 153 or chamber of the marker.

In one embodiment, the bolt 105 is driven by a striker mechanism. The striker mechanism can include a striker 101, a striker spring 129, a striker spring housing 125 and a striker shaft. The striker 101 is situated in a first compartment 155 that is adjacent and parallel to the barrel 153. The striker spring 129 and striker spring housing 125 are disposed in a second compartment 157. The striker spring housing 125 and striker 101 are attached to one another by the striker shaft, which runs parallel with the barrel 153, but is primarily external to the housing of the marker.

The striker 101 is coupled to the bolt 105 by a bolt pin 103. As a result, if the striker 101 moves, then the bolt 105 moves in tandem. The striker 101 can have any size or shape that complements the size and shape of the first compartment 155. For example, the first compartment 155 and striker 101 can be cylindrical. The size and weight of the striker 101 can be selected to balance the air pressure exerted against the striker and the force of the striker spring 129. The striker 101 also moves between two positions: a cocked position and an activated position. In the activated position, the striker 101 contacts the valve 109 to activate the valve 109. In the cocked position, the striker 101 is at a proximal position in the first compartment 155 and not in contact with the valve 109. In this position, the valve 109 is closed and gas does not pass through the valve 109 into the bolt 105 and barrel 153.

The valve 109 includes a body, cup seal 111, valve spring 113 and valve pin 107. The valve body defines an interior chamber 177 through which the valve pin is disposed. The striker 101 opens the valve 109 by contacting the valve pin 107. The valve pin 107 in turn pushes the cup seal 111 away from the interior walls of the valve body allowing gas to pass through the interior chamber 177 of the valve 109 and into the first compartment 155 and into the barrel 153 if the bolt 105 is positioned to open the airflow path. The valve spring 113 biases the valve to a closed position by pressuring the cup seal 111 into the interior walls of the valve body.

The valve 109 also defines a reservoir 179 and airflow path 181 and an opening, referred to herein as a blow back hole, leading from the interior chamber 177 to the first compartment 155. The reservoir 179 can have any size or dimensions. The reservoir can have a volume that is approximately equal to or larger than the volume of the path to the bolt 105. In one embodiment, the reservoir 179 has a volume that is zero to thirty percent greater than the bolt hole. In one example embodiment, the reservoir volume is twenty percent larger than the bolt hole volume. The size and dimensions of the reservoir 179 increase the capacity of the interior chamber 177 and increases the amount of air available to blow back the striker 101 to a cocked position. The larger relative size of the reservoir 179 diverts compressed gas and air pressure toward the blow back hole as a path of lesser resistance. In one embodiment, the reservoir 179 has a diameter of 2 mm to 5 mm. In one example embodiment, the bolt hole has a diameter of 3.5 mm. The reservoir 179 can be positioned to effect a specific airflow diversions. For example, the reservoir 179 can be positioned opposite the bolt hole or adjacent to the bolt hole.

The airflow path 181 and blow back hole provide a path for the increased flow of air into the first compartment 155 to blow back the striker 101. The airflow path has a length of 2 mm to 20 mm and the blow back hole and airflow path has a diameter of 0.25 to 3.5 mm. In one example embodiment, the diameter of the blow back hole and airflow path 181 are 1.9 mm. The airflow path 181 and blow back hole can also be positioned to affect specific diversions of gas to the first compartment. The relative diameters of the bolt hole and airflow path 181 also determine the percentage of airflow along each path as the greater volume of compressed gas follows the larger airflow path and generates the larger air pressure. In one example embodiment, the specific use of a 1.9 mm diameter airflow path 181, 3.5 mm diameter reservoir and 3 mm bolt hole creates approximately a 70% to 30% relative flow to the bolt hole and blow back hole, respectively.

The reservoir 179 in combination with the airflow path 181 and blow back hole divert a larger portion of the compressed gas that is released into the interior chamber 177 when the valve 109 is activated. As a result, the striker 101 is more likely to be successfully cocked even when the overall pressure of the compressed gas is low. The relative flow of the compressed gas can be 60-85% to the bolt and bolt hole and 40 to 15% to the first compartment to blow back the striker 101. In one example embodiment, 70% of compressed gas is directed toward the bolt hole and 30% is directed toward the reservoir 179 and blow back hole. Use of a reservoir 179, airflow path 181 and blow back hole provides a greater degree of precision in the management of air pressure and its application to the paintball through the bolt and the striker 101 in comparison to embodiments where airflow to the first compartment 155 is restricted to airflow around the valve pin 107. Altering the dimensions of the valve pin 107 and valve pin hole can negatively impact their function in opening and dosing the valve.

A second compartment 157 includes a striker spring 129 and striker spring housing 125. A front compartment plug 119 seals the second compartment 157 and provides access to the second compartment 157, if removed. The front compartment plug 119 can be screwed into or similarly attached to the second compartment 157 to seal it. In one embodiment, the front compartment plug 119 is made from a compressible material such as foam, fabric, elastomeric material or similar materials. The front compartment plug 119 compresses when the striker spring housing 125 is released by the sear 127 and decompresses when the striker spring housing 125 returns to a position where the sear 127 engages it. In other embodiments, the front compartment plug 119 is solid and disposed at the furthest extent of the striker spring housing 125 movement range.

In one embodiment, the striker spring 129 biases the striker 101 to an activated position by exerting a force on the striker spring housing 125 pushing it toward the distal end of the marker. The striker spring housing 125 is connected to the striker 101 by a striker shaft (illustrated in FIG. 5) and thereby transfers the biasing force of the striker spring 129 to the striker 101.

The second compartment 157, striker spring housing 125 and striker spring 129 can have complementary shapes and sizes such that the striker spring housing 125 can be slidably disposed within the second compartment 157 and the striker spring 129 can engage the striker spring housing 125. The striker shaft can be dimensioned with sufficient length to connect the striker 101 with the striker spring housing 125 and sufficient width and material strength to transfer the force of the spring to the striker 101 in the first compartment 155.

In one embodiment, the striker spring housing 125 engages a trigger 133 through a sear 127. The sear 127 catches the striker spring housing 125 to hold it in a proximal position in the second compartment 157 preventing it from advancing the striker 101 to activate the valve 109. Activation of the trigger 133 by a user disengages the sear 127 from the striker spring housing 125 allowing the striker spring 129 to advance the striker spring housing 125 and the striker 101 thereby opening the valve 109 and releasing the gas to propel the paintball.

The trigger 133 is connected to the sear 127 by a connecting cable 171 and sear activator 173. The sear activator 173 is pivotally coupled to the housing and rotates from a first position to a second position. The sear activator 173 is biased by a sear activator spring 175 to the first position. The first position is tied to the resting position of the trigger 133. The biasing of the sear activator 173 also biases the trigger 133 via the connecting cable 171. In the second position, the sear activator 173 engages the sear 127. Engaging the sear 127 rotates the sear 127 to move it from a protruding position (i.e., protruding into the second compartment 157) to a retracted position. The sear 127 is pivotally coupled to the housing and a sear biasing spring 183. The sear biasing spring 183 biases the sear 127 to the protruding position to engage the striker spring housing 125.

In another embodiment, the trigger assembly can include electronic components that enable automatic fire, multiple paintball firings per trigger pull or similar functionality. Electronic trigger components can include a trigger depression sensor, an integrated circuit for controlling the sear to affect the desired functionality and similar components. In one embodiment, motors, solenoids or similar mechanisms can be used to replace the biasing springs 175, 183 to allow an integrated circuit to directly position the sear 127 and sear activator 173 in response to user engagement of the trigger 133. Electronic components can also provide other functionality or information related to the function of the marker or the operating conditions. For example, electronic components can include sensors for gas pressure, paintball count, temperature and similar conditions and electronic displays for displaying sensor information and similar electronic components.

In one embodiment, compressed gas can be provided as propellant for firing paintballs. The compressed gas can be compressed carbon dioxide, compressed air or similar compressed gas. The compressed gas can be stored in an internal storage device such as a sparklet or similar container. The container can be steel, aluminum, wound carbon-fiber or similar construction. The compressed gas container 149 can be disposed within a handle or similar cavity of the housing of the marker. The compressed gas container 149 can be held in position by a plug 147 or similar retaining mechanism. The compressed gas container 149 can engage the first compartment 155 of the valve 109 to supply pressurized gas into those spaces and components to be utilized to propel a paintball out of the marker. The compressed gas container 149 can be screwed into or similarly attached to the housing and the first compartment.

In one embodiment, the compressed gas container 149 can be removable and replaced when emptied. For example, the compressed gas container 149 can be a 12 g compressed $CO_2$ cartridges that can be replaced after it is expended. In another embodiment, the compressed gas container 149 can be refilled within the marker without removing it from the marker. In a further embodiment, an external tank can be connected to the marker in place of a compressed gas container 149. The connection for an external gas tank can be disposed through the plug 147 or similarly attached. The source of gas and the pressure of the provided gas can be compensated by adjustment of the type, size, placement or force of the springs in the marker.

In one embodiment, the paintballs can be fed into the marker by a charger 137. The charger 137 can contain any number of paintballs. The charger 137 can feed the paintballs into the chamber or barrel 153 of the marker one at a time. The charger 137 can hold the paintballs in-line. In one embodiment, the charger 137 is disposed substantially vertical or at a slight angle to the barrel 153 and within a handle portion of the marker. In another embodiment, the charger 137 can attach to the marker from a horizontal disposition or similarly engage the marker.

A latch mechanism or similar mechanism can be used to hold paintballs in the charger when a paintball is already in the barrel 153. The charger 137 can include a pusher, charger spring 143 and charger plug. The pusher can be coupled to the charger spring 143, which exerts a biasing force on the pusher to push the paintballs into the barrel 153 of the marker. The charger spring 143 can press against the charger plug to compress the pusher into the chamber or barrel 153 of the marker. The charger 137 can hold any number of paintballs. In one embodiment, the charger 137 can be removably attached to the marker. For example, the charger 137 can be removed when empty and another full charger can be inserted in its place while the original is reloaded. The charger 137 can be disposed entirely within the housing of the marker or can protrude from the housing, e.g., from the bottom of the handle, or similarly have portions that are external to the housing.

In one embodiment, the housing of the marker can include a frame and body or similar components. The housing can have any number of sections that can be attached to one another to form a marker in the shape of a pistol or similar handgun. The components of the housing can be removably coupled to one another to allow access to the internal components to remove or maintain the internal components.

In one embodiment, a cocking block 115 can be attached to the marker over the housing. The cocking block 115 can have any shape or size sufficient to let a user grip the cocking block 115 to use it to ready the marker. The cocking block 115 can be used to move the striker mechanism and bolt from an activated position to a deactivated position if not automatically transitioned to that state during operation.

Figure 2:
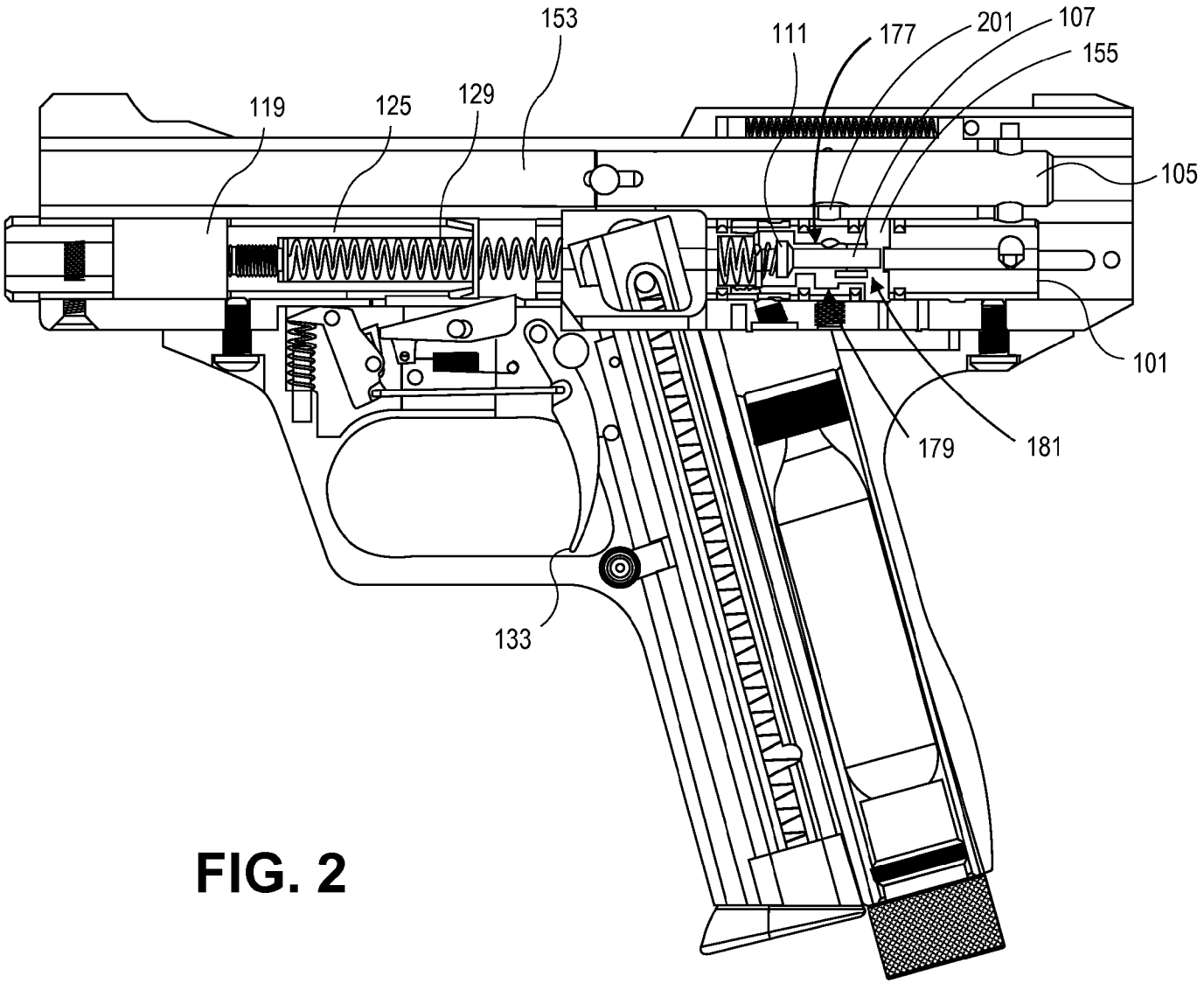
FIG. 2 is a diagram depicting a cross-section of one embodiment of a compact marker and valve mechanism where the valve is activated.

FIG. 2 is a diagram depicting a cross-section of one embodiment of a compact marker and valve where the striker mechanism has activated the valve. In response to depression of the trigger 133, the striker spring housing 125 is released and the striker spring expands thereby moving the striker spring housing 125 and striker 101 to their distal or activated positions. The distal movement is restricted by the front compartment plug 119 or the maximum expansion of the striker spring 129.

The striker 101 in the distal position displaces the valve pin 107 and the cup seal 111. This opens a passage between the compressed gas source and the interior chamber 177 of the valve. The compressed gas flows through the interior chamber 177 and into the bolt hole 201 and reservoir 179. The compressed gas flows through the bolt hole 201 to the barrel 153 to propel the paintball out of the marker. The compressed gas also flows through the airflow path 181 to the blow back hole and the first chamber to force the striker back to a cocked position.

Figure 3:
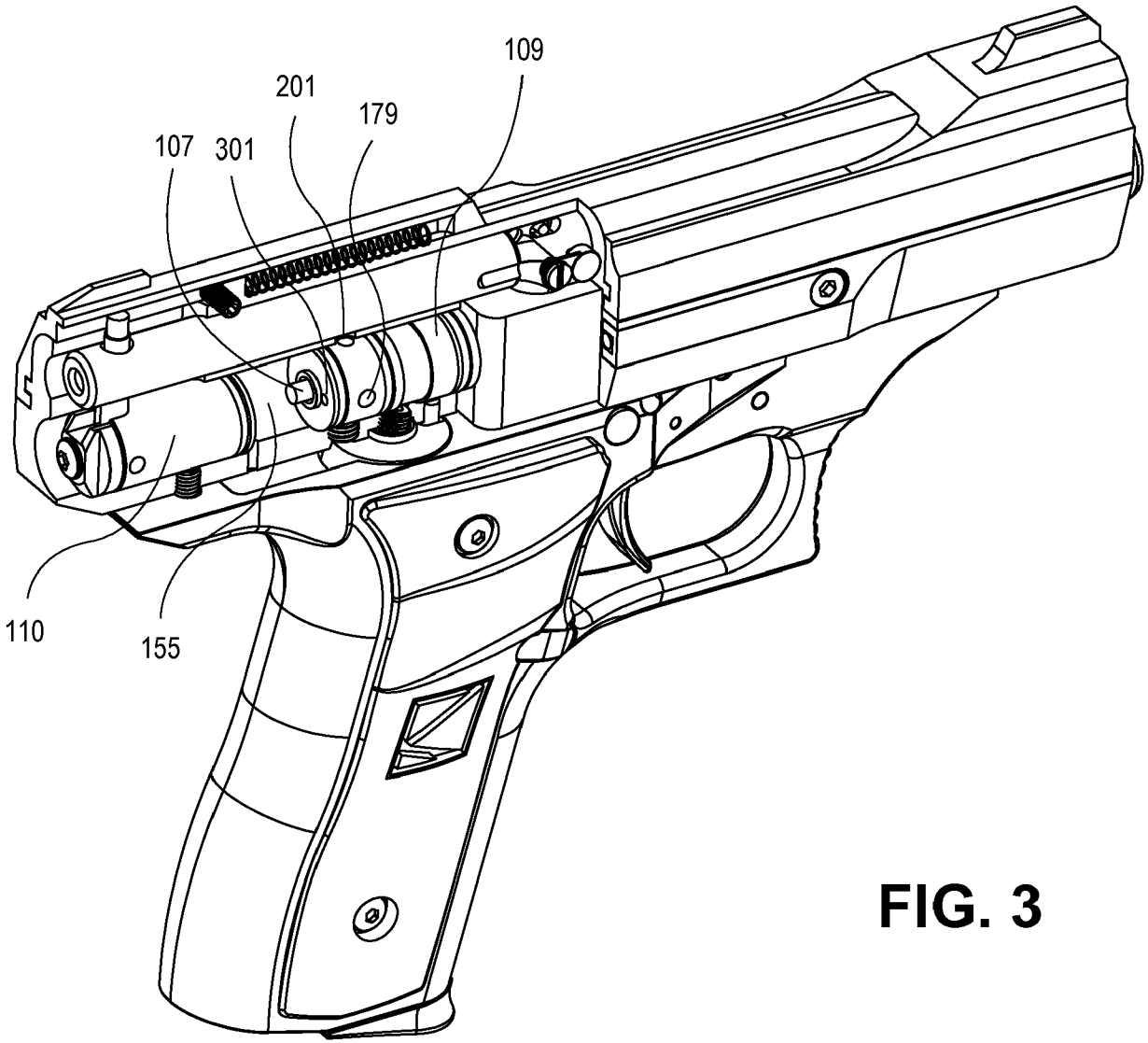
FIG. 3 is a diagram depicting a cross-section of one embodiment of a compact marker and valve mechanism where the exterior of the value is visible.

FIG. 3 is a diagram of one embodiment of the marker illustrating a cut-away showing the exterior of the valve 109. The valve 109 is disposed within the first compartment 155 distal to the striker 101. The valve pin 107 is exposed to the striker 101 and can be displaced when the striker is in the activated position thereby open the interior chamber of the valve 109 to allow the flow of compressed gas into the barrel and the first chamber.

In one embodiment, the reservoir 179 is defined by the body of the valve 109 as a recess in the interior chamber. In another embodiment, the reservoir includes an opening on the exterior of the valve body. The opening can have any size or dimension to create a reservoir with any volume that is approximately equal to or greater than that defined by the bolt hole. In one example embodiment, the reservoir 179 opening is approximately the same size as the bolt hole opening 201.

The blow back hole 301 can be positioned in any part of the exterior distal wall of the valve 109. The blow back hole 301 can have any shape or dimension. The blow back hole can have an diameter of 0.25 to 3.5 mm. In one embodiment, the blow back hole diameter is 1.9 mm. In another embodiment, multiple blow back holes and air passages connecting the blow back holes to the interior chamber can be defined by the valve.

Figure 4:
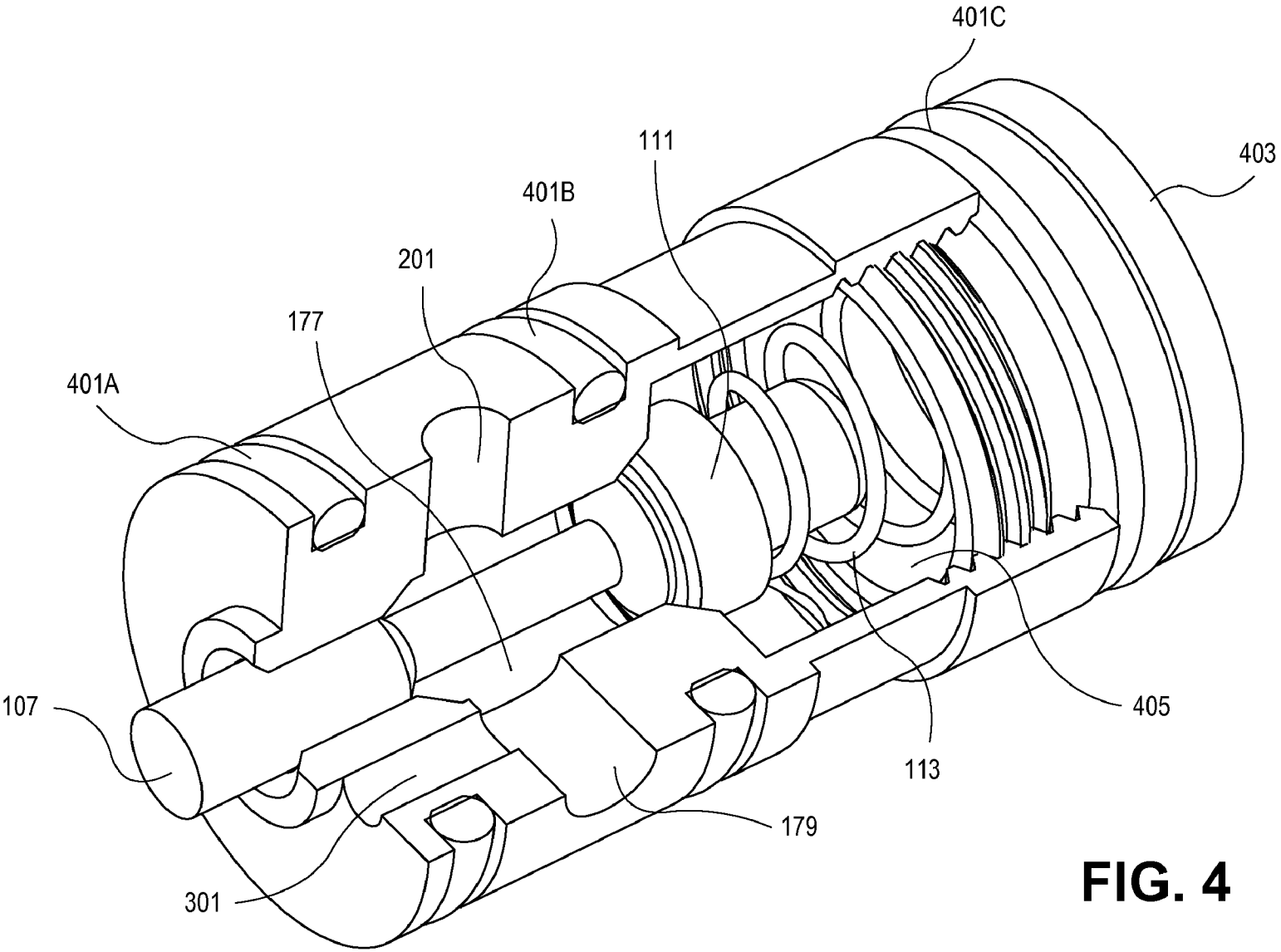
FIG. 4 is a diagram of one embodiment of the components of the valve mechanism.

FIG. 4 is a diagram of one embodiment of the components of the valve. The valve 109 includes a set of O-rings 401A-C, valve pin 107, valve spring 113, cup seal 111, valve plug 403 and body. The body defines an interior chamber 177, a blow back hole 301, a reservoir 179, a spring chamber 405, a valve pin opening and a set of exterior ridges to receive the O-rings. The valve body can be formed of any high-strength material including stainless steel, aluminum, iron, titanium, metal alloys and similar materials.

The O-rings 401A-C are positioned around the circumference of the valve 109 to seal the valve within the first compartment to prevent the movement of the compressed gas absent the activation of the valve pin 107 by the striker 101. The O-rings 401A-C can be formed of any flexible or elastic material including natural or synthetic rubber, resin, plastic or similar materials. The circumference of the O-rings can match the perimeter or exterior circumference of the valve in the recesses or ridges defined by the valve body. The O-ring 401C also serves to seal the connection between the valve plug 403 and the valve body.

The valve plug 403 encloses one end of the valve and can be removably connected to the valve to enable access to the valve pin 107, cup seal 111 and valve spring 113 for maintenance and assembly. The valve plug 403 can be coupled with the valve body through complementary threading or similar attachment mechanism.

The valve spring 113 can be formed of any suitable material that retains its shape and is elastic allowing the storage of mechanical energy to bias the positioning of the valve pin 107 and cup seal 111. The valve spring 113 can be formed from hardened steel, annealed steal or similar materials.

The cup seal 111 is attached to the valve pin 107 and is formed from a combination of materials to provide a seal and divide the two interior compartments of the valve. The cup seal 111 can be formed from any high-strength material including steel, titanium, aluminum, metal alloys and similar materials. The cup seal 111 can include natural or synthetic rubber, plastics or similar sealing materials on or attached to the surface facing the valve pin 107. This forms an airtight seal between the two compartments when pressed by the valve spring 113.

The valve pin 107 is attached to the cup seal 111 and protrudes through an opening in the distal end of the valve. The valve pin 107 translates the force of the striker 101 to displace the cup seal 111 and open an airflow path between the compressed gas source and the bolt hole 201 and blow back hole 301. The valve pin 107 can be coupled to the cup seal 111 through complementary threading, adhesive or similar attachment mechanism. The valve pin 107 can also be integrally formed with the cup seal 111. The valve pin 107 can occupy all or a part of the valve pin opening at the distal end of the valve determining the amount of compressed air that passes through the valve pin opening.

The valve body defining interior compartments including the interior chamber 177 and spring chamber 405, interior spaces and pathways including the bolt hole 201, reservoir 179, blow back hole 301 and exterior surface ridges and similar structures can be formed from any high-strength material including steel, titanium, aluminum, metal alloys and similar materials. The shape and structure of the body can be formed by casting, machining or similar techniques.

Figure 5:
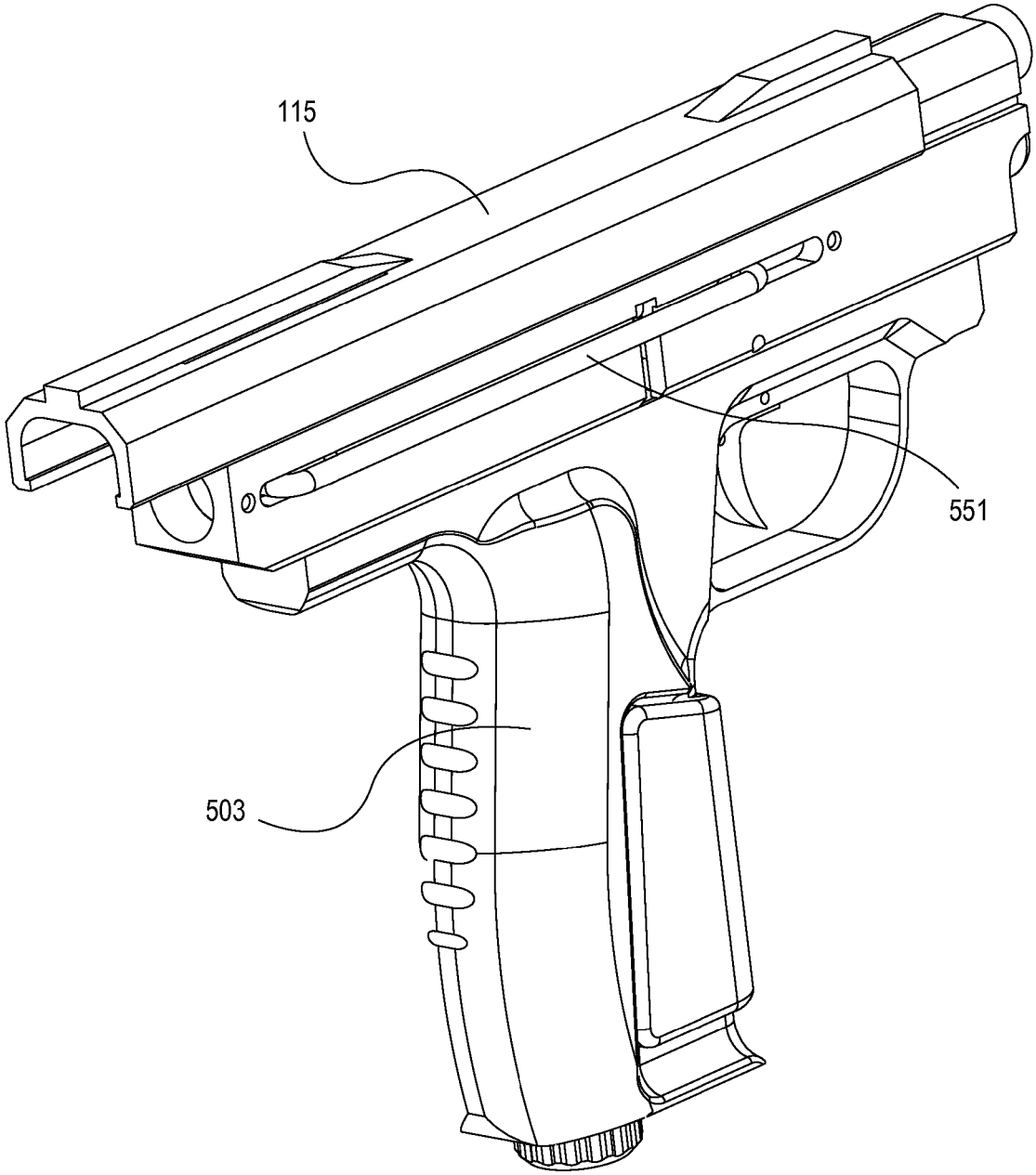
FIG. 5 is a diagram of one embodiment of the exterior of the marker.

FIG. 5 is a diagram of the external housing of one embodiment of the compact marker. In one embodiment, the external housing 503 can have any number of individual sections, plates or similar components. The housing can be constructed from metal, plastics, resins or similar materials or combinations thereof. The housing can be shaped to define a handle portion and projection portion.

In one embodiment, the housing defines a space that allows the striker shaft 551 to move between two different positions. Similarly, the cocking block 115 can cover or sheath a portion of the housing. The cocking block 115 can be slidably coupled to the marker through an opening defined by the housing, allowing the cocking block 115 to engage the bolt mechanism in a back position. The cocking block 115 can have any shape, size or dimensions suitable for being gripped by the user to ready the marker for firing. In one embodiment, the cocking block 115 can define a set of sights or similar structures common to markers.

A cocking block 115 can be advanced to a back or proximal position by the application of lateral force by a user. This movement causes the cocking block return spring to be compressed against the protrusion of the housing. If the manual force is removed, then the compressed spring will bias the cocking block 115 back to the front position.

The cocking block 115 engages the bolt pin in the back or proximal position. As a result, the bolt can be advanced to a cocked position. A protrusion on the lower surface of the cocking block 115 engages the bolt pin. This mechanism can be referred to a snap catch mechanism. In other embodiments, other types of mechanism for advancing the bolt to the cocked position without tying it to the movement of cocking block in both directions can be utilized.

Figure 6:
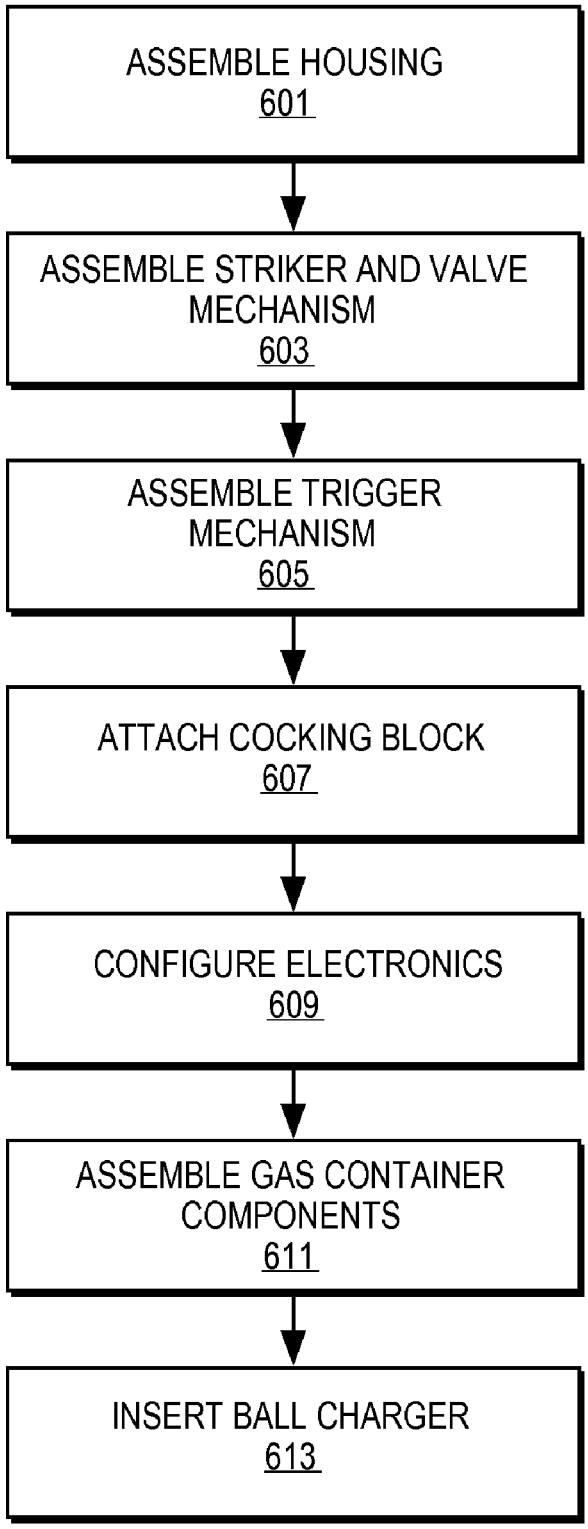
FIG. 6 is a diagram of one embodiment of a process for manufacturing the compact marker.

FIG. 6 is a diagram of one embodiment of a process for manufacturing the compact marker. In one embodiment, a marker manufacturer can be responsible for the assembly of the marker. In another, embodiment, the manufacturer can also fabricate at least some of the parts of the marker. The marker can be mass produced by automated or manual assembly.

In one embodiment, the assembly process begins with the assembly or partial assembly of the housing of the marker (block 601). The individual components of the housing can be fabricated out of metals such as aluminum, steel and similar metals, plastics, resins and similar materials. The components can be combined by machining, attachment mechanisms such as snap fit, screws, interlocking parts, welding or similar techniques.

In one embodiment, the striker assembly and valve can then be inserted into the housing or partially constructed housing (block 603). The striker assembly components can be fabricated from metals, plastics, resins and similar materials. The components of the striker assembly may include a set of O-rings that prevent the leakage of gas around them thereby forming an airtight compartment. The striker assembly can be calibrated or similarly tested to ensure that the striker assembly is properly balanced against the air pressure supplied to the marker to ensure that the marker will recover properly.

The valve can also be inserted into the first compartment distal to the position of the striker. The valve may be attached to a tube or similar structure that connects the compressed gas source to the valve. The valve also requires pre-assembly of its internal components. The valve assembly includes attaching the valve pin to the cup seal. The valve pin and cup seal are then inserted into the valve body such that the valve pin protrudes from the distal end of the valve. The valve spring is inserted and compressed against the cup seal by the valve plug, which may be screwed into place or similarly attached. A set of O-rings are attached around the exterior surface of the valve body.

In one embodiment, the trigger assembly can then be added to the housing (block 605). The trigger assembly can include any combination of mechanical or digital components including those described herein above. Different models can have different components. For example, high end models may have digital components and features that allow for multiple paintballs to be fired in succession with any action by the user or similar functionality. Low end models may have entirely mechanical triggering mechanisms. The sear, sear activator, biasing springs and similar components of the trigger assembly can be formed from any combination of polymer, resin, metal or similar material. The components can be manually or automatically assembled.

In one embodiment, the cocking block is attached to the bolt of the marker over the top portion of the marker (block 607). The cocking block can have any shape or dimensions. In one embodiment, electronics such as temperature gauges, compressed air gauge, firing control and similar components can be added to the marker (block 609). These components can be programmed prior to installation or after installation.

In one embodiment, the manufacturer can also assemble the gas delivery components (block 611). The main container can be placed in the handle of the marker. The container can be removed for filling and locked back into place using the plug. In other embodiments, the gas delivery components can be fixed in the system or external to the system.

In one embodiment, a ball charger can be added to the marker (block 613). The ball charger can be added as integral part of the housing and components of the charger can be placed within the housing. In another embodiment, the charger can be added by a user after retail purchase.

In the foregoing specification, the embodiments of the invention have been described with reference to specific embodiments thereof. It will, however, be evident that various modifications and changes can be made thereto without departing from the broader spirit and scope of the invention as set forth in the appended claims. The specification and drawings are, accordingly, to be regarded in an illustrative rather than a restrictive sense. For example, the embodiments described herein have been drawn to a compact handgun shaped marker. However, one skilled in the art would understand that the structures and principles of the valve mechanism described herein can also be applied and utilized in other types of markers including standard rifle shaped markers.

What is claimed is:

1. A pneumatic projectile launcher comprising:

a housing defining a compartment in which a striker resides;

a valve body defining an interior chamber, valve pin opening, a reservoir, a bolt hole and a blow back hole both the valve pin opening and the blowback hole providing fluid communication between the interior chamber and the compartment;

a seal disposed within the valve body; and a valve pin coupled with the seal to control airflow into the interior chamber.

2. The apparatus of claim 1, further comprising:

a valve spring to bias the valve pin to a closed position.

3. The apparatus of claim 1, wherein the reservoir defines a space having a volume greater than or equal to a volume of a space defined by the bolt hole.

4. The apparatus of claim 1, wherein the blow back hole has a diameter of 0.25 millimeters to 3.5 millimeters.

5. The apparatus of claim 1, wherein the reservoir, bolt hole and blow back hole are contiguous with the interior chamber.

6. The apparatus of claim 1, wherein the valve body defines an opening for the blow back hole adjacent to the valve pin opening.

7. The device of claim 1, wherein the housing defines a cavity to receive a compressed gas container.

8. The pneumatic projectile launcher of claim 1 wherein the blow back hole defines an inlet port within the reservoir and an outlet port in the compartment.

9. A device comprising:

a marker housing;

a bolt coupled to the housing;

a valve coupled to the housing to release a compressed gas through the bolt to propel a paintball, the valve defining an interior chamber, valve pin opening, a bolt hole, a reservoir, a blow back hole both the valve pin opening and the blowback hole providing fluid communication between the interior chamber and a compartment; and a striker mechanism to activate the valve in response to activation of a trigger mechanism the striker mechanism residing in the compartment.

10. The device of claim 9, wherein the housing is in the form of a hand gun that is less than ten inches in length.

11. The device of claim 9, wherein the reservoir defines a space having a volume greater than or equal to a volume of a space defined by the bolt hole.

12. The device of claim 9, further comprising:

a ball charger that is removably coupled to the marker.

13. A method comprising:

inserting a striker in a first compartment of a housing of a pneumatic projectile launcher;

inserting a spring mechanism in a second compartment of the housing;

linking the striker and spring mechanism with a striker shaft, a portion of the striker shaft is external to the housing;

inserting a bolt into a third chamber, the bolt coupled to the striker; and inserting a valve defining an interior chamber, valve pin opening, reservoir, bolt hole and blow back hole in the housing to release a flow of compressed air into the first compartment from the interior chamber through the blow back hole and the valve pin opening and into the third chamber through the bolt hole in response to activation by the striker.

14. The method of claim 13, further comprising:

coupling a trigger mechanism to that housing such that a sear is forward of the trigger, the trigger mechanism to activate the striker to propel a paintball.

15. The method of claim 13, further comprising:

inserting a compressed gas canister into a handle of the housing to provide propellant to propel the paintball.

16. The method of claim 13, further comprising:

coupling a cocking block to the striker and bolt, the cocking block including a sheath covering a portion of the housing.

17. The method of claim 13, further comprising:

inserting a spring in the first compartment to bias the valve to a closed position.

18. The method of claim 13, wherein the reservoir defines a space having a volume greater than or equal to a volume of a space defined by the bolt hole.

* * * * *